US008454541B2

(12) United States Patent
Olsen

(10) Patent No.: US 8,454,541 B2
(45) Date of Patent: Jun. 4, 2013

(54) TRAINING APPARATUS FOR THE DISABLED

(75) Inventor: Anund Olsen, Skien (NO)

(73) Assignee: Made For Movement Group AS, Skien (NO)

( * ) Notice: Subject to any disclaimer, the term of this patent is extended or adjusted under 35 U.S.C. 154(b) by 562 days.

(21) Appl. No.: 12/527,613

(22) PCT Filed: Feb. 19, 2008

(86) PCT No.: PCT/NO2008/000064
§ 371 (c)(1),
(2), (4) Date: Mar. 26, 2010

(87) PCT Pub. No.: WO2008/103052
PCT Pub. Date: Aug. 28, 2008

(65) Prior Publication Data

US 2010/0222716 A1 Sep. 2, 2010

(30) Foreign Application Priority Data

Feb. 19, 2007 (NO) ..... 20070872

(51) Int. Cl.
*A61H 1/00* (2006.01)

(52) U.S. Cl.
USPC ..... 601/34

(58) Field of Classification Search
USPC ..... 601/5, 23, 26, 34, 35, 29, 31, 32, 601/36; 482/51, 54, 52, 57, 66, 69, 70
See application file for complete search history.

(56) References Cited

U.S. PATENT DOCUMENTS

| | | | | |
|---|---|---|---|---|
| 219,439 | A * | 9/1879 | Blend | 601/23 |
| 5,054,852 | A | 10/1991 | Tholkes | |
| 6,440,046 | B1 | 8/2002 | Tholkes | |
| 6,770,040 | B2 * | 8/2004 | Perner et al. | 601/5 |
| 2002/0010056 | A1 | 1/2002 | Borsheim | |
| 2006/0229167 | A1 | 10/2006 | Kram | |

FOREIGN PATENT DOCUMENTS

| | | | |
|---|---|---|---|
| EP | 0 237 395 | A1 | 8/1987 |
| EP | 1 647 254 | A | 4/2006 |
| JP | 2004208976 | | 7/2004 |
| WO | WO 2005/122692 | A2 | 12/2005 |
| WO | WO 2005/122692 | A3 | 12/2005 |

OTHER PUBLICATIONS

ISR and Written Opinion of the International Search Authority PCT/NO2008/000064.

* cited by examiner

*Primary Examiner* — Jackie Ho
*Assistant Examiner* — Mark Wardas
(74) *Attorney, Agent, or Firm* — Merchant & Gould P.C.

(57) ABSTRACT

Apparatus for disabled persons, comprising a skid which optionally may be equipped with wheels, to which skid is connected a device for tightening the user's knees.

4 Claims, 2 Drawing Sheets

TRAINING APPARATUS FOR THE DISABLED

RELATED APPLICATIONS

This application claims priority from International PCT Application No. PCT/NO2008/000064, filed on Feb. 19, 2008, which claims priority from Norwegian Patent No. 20070872, filed Feb. 19, 2007, the disclosures of each of which are incorporated herein by reference in their entireties.

AREA OF THE INVENTION

The present invention relates to an apparatus for disabled persons that makes it possible for the disabled to do training in order to be more bodily able, and assist and aid assistant personnel and liberate workforce by rendering unnecessary the need for more nurses to serve a disabled person. The device according to the present invention may make possible for the disabled to move around by carrying out walking movements with the legs, and thereby operate the device. Alternatively, such a device according to the present invention may carry out motor-assisted movement for people who do not have the capacity, either neurologically and/or muscularly to move alone.

BACKGROUND FOR THE INVENTION

Seriously disabled users, e.g. persons with cerebral paresis, persons with traffic injuries or persons suffering from neurological diseases (e.g. Parkinson's disease) or muscular diseases (muscular dystrophy, coordination failures etc.) with limited control of their legs, experience difficulties in moving in such a way that involves use of the legs as well as experience problems with the coordination that is required to direct the body to a standing or walking attitude. Also, such individuals who for a prolonged amount of time are in a sleeping or sitting position due to muscular limitations or other functional failure, may obtain inter alia atrophy in muscles and limbs. When the muscles lose the possibility of active use with stretching, and at the same time lacking sensibility, there is a risk of damage to the nervous system, and it will finally lead to the muscles developing atrophy. In the absence of physical training, these individuals will not only be subject to more progressive muscular weakening, but also get aggravated health because of poor blood circulation, which again gives arise to a number of secondary effects, such as an increased tendency of blood thrombosis, wounds in the skin due to reduced blood supply to surface tissue, impairment of the heart etc.

The therapeutical methods for helping and assisting in movement of the limbs for such disabled persons are today comprised of exercising by stretching, which is often carried out with the aid of a therapist. These methods generally comprise different mechanical supports for helping the patient into a position which is more or less vertically upright. Leg movements will then be made with the aid of the therapist. Such methods are useful, but have a number of inherent limitations. Primarily, these methods are labour intensive and require continuous supervision and help from at least one, and often several therapists. Further, many of these methods and devices will not be helpful in a movement which gives a repetitive and continuously coordinated muscular movement and do not contribute to the disabled following the most desirable movement for the effective training of these bodily parts. The most favourable motion patterns for the training of nerves and muscles are such motions which occur for healthy persons, because muscles, the skeleton and neurological pathways are arranged for carrying out such movements. Training of isolated muscle groups may in many cases help a patient is locally but complex movements, such as erection of the body and walking, will assist and train the disabled in a far more efficient way than local stimulation of isolated muscles or muscular groups.

Moreover, most training methods and/or devices will require interaction between the patient and the therapist. Generally the patient will have to be present at a hospital or a special training centre in order to make it possible to have help from the therapists to carry out the training exercises. It is desirable to have an apparatus which can be placed at home, and which can be handled either alone or with for example other family members, in addition to being used in a nursing situation at for example a nursing centre or a hospital.

It is thus known from U.S. patent application 2002/0010056 a treadmill, in which a nurse assists a disabled person in walking, where the nurse is connected to a device and the nurse's leg movements are transferred to the disabled person (who is placed in a supporting strap).

From U.S. Pat. No. 6,440,046 is known a chair device for straightening up the back of disabled persons from a seated position, but where the disabled, after being brought to a standing position, then stands still without movement of the legs.

From JP Patent Application 2002382553 is known a device which may help patients who are not able to take an upright position to move the legs. Such a device is, however, like the other above-mentioned devices, run by the muscular power of the patient himself, and the patient must therefore use his own muscles in order to move the device. In particular cases, in which the present invention is directed towards, the individual is not capable of carrying out the relevant movements, either because coordination is not present (Parkinson's disease, cerebral paresis) or because the muscles cannot be activated by will (spinal injury).

Consequently there is a need for a compact type of apparatus which brings the persons up into desirable training positions, with the least possible help from others. This type of apparatus will preferably also have the feature of providing all natural movements and support for the legs and body in the required positions and training exercises. There to is also a need for such an apparatus which is activated by the aid of an external power source, such as a motor, e.g. an electromotor, such that the motor movements of the patient are actively assisted.

For persons who have somewhat advanced in a training programme or treatment, it can be useful to avoid an external power source, so that the patient may increasingly use his own muscles to move the device. It is also required, for persons who are not able to do movements on their own, a machine which is motor driven and which performs the relevant walking movements forced onto the patient.

Various training equipment has been designed in order to make it easier with different movement training. Examples comprise treadmills which make it possible to walk or run on the spot; stepping machines which make it possible to climb or have step movements on the spot; bicycles which make it possible with cycle movements on the spot; and other apparatus which make it possible to skate or walk with skiing movements on the spot. Another type of apparatus makes possible somewhat more complicated movements and simulates more realistic walking movement, for instance apparatus with an elliptic movement. Training equipment has, however, the contrivance that they shall train persons who are already able (training muscular power, stamina, muscular tones, etc.) and are not arranged to be used on individuals who start from the point where they cannot perform the required movements at all, or can only perform parts of such complicated movements, or do not have the sufficient strength for such movements, even though the nerve impulses to the muscles are functioning normally. The actual movement patterns in such apparatus are however intended for natural movement of legs and body, but are not suitable for patients who are disabled.

With "abled" is meant, in this context, movement of a limb (the legs) which is carried out with the aid of normal nerve signals emitted from the brain, and which work on muscles moving the skeleton, where the muscles have sufficient strength (have sufficient muscular mass) to move by will the relevant limb, as well as possibly to hold the person upright.

An advantage of a training exercise with elliptical movement is that the user's foot is going up and down, as well as back and forth during a training cycle. Additionally, it is a purpose with the device, according to the present invention, preferably to provide as natural a walking movement for the legs as possible. As mentioned above, it is also one of the many purposes of the present invention to provide various movement patterns for the legs. Further, it is one of the many purposes of the present invention to provide the possibility of gradual adaptation of the relevant movement patterns by being able to vary the movement strokes for the relevant movements from a relatively small stroke to a natural stroke. This is an advantage, since new movements for disabled can be connected with anxiety and mental dislike, and gradual adaptation will then be advantageous.

SUMMARY OF THE INVENTION

The present invention provides an apparatus for training the disabled and motionally handicapped persons with different types of walking movements (natural walking, ski walking, stair walking, etc.). Preferably the device, according to the invention, will provide a movement with an approximated natural walking, stair walking or skiing movement with a motorised device. Such relevant movements can also be provided with a device according to the invention which is adapted for muscular controlled exercise for walking movement. The invention is featured by the fact that a movement device for the compensation of lack of stretching the legs is also applied. Such a natural stretching of the legs can be provided whereby the forward movement of a leg (when this is moved forward) is connected to a corresponding and backward movement of the other leg by a device of elastic band, spring, strap or bar, which coordinates and controls the stretching of the knee and the rear femoral muscle by pulling the knee backwards when the other leg is moved forward in natural walking. Such a device of elastic band, spring, strap or bar is suitably attached to the upper part of the leg, just below the knees, and coordinates the pattern of movement in the bending of the knees when the legs are bent and stretched in a walking movement, as explained above and as described in further detail below. Such a cooperative device for the alternate stretching of the user's knees can also be constituted of rigid bars which are connected to a horizontal rotatable lever disk, such that the same function, as explained above, is obtained by the forward and backward guiding of the user's legs in a walking movement.

Further, the invention is also featured in that it comprises a seating device, such as a chair, where the seating device includes a corrective rail which constitutes a part of the back support for the seating device, and has the function of a spinal column for attachment to the upper part of the person's body. Such a support for the back may also function as a support for lateral movements of the upper part of the user's body. The chair device is constituted of a vertical parallelogram of rods for the formation of, for instance, a rhombus or, alternatively, a sickle-formed bar, where these are hinged in the corners, and which upon erection guide the user into an upright position. In horizontal position the parallelogram or bar comprises a seating area which constitutes the seat of to the chair. To this seat of the chair, the above-mentioned corrective rail is hinged, preferably with a support for the lumbar region, such that the chair seat, support for the lumber region and the corrective rail in essence constitute a straight line when the device is moved into an upright position. With the above-described device for movement of the legs, in upright position, the chest attachment onto the supporting rail, is the support for the lumbar region, and the leg support, will constitute three attachment points, which together will even keep a paralysed person in an upright position, where the upright position is essentially maintained with the aid of the user's own skeleton. By, in a motorised device according to the invention, also attaching the user's feet to a movement device of the above-mentioned type with elliptical movement, ski walking or stair movement, where the movement device for example comprises rails attached to an elliptical wheel, which is run by a motor, upon activation of the motor, the user will be forced to do an upright walking, skiing or stair step movement, which straightens the muscles and improves the function of nerve and coordination. Alternatively, the motorisation of the movement can be controlled such that the motor can assist, and not completely carry out, the relevant walking movement by reducing the motor power.

SHORT DESCRIPTION OF THE DRAWING

DETAILED DESCRIPTION OF THE PREFERRED EMBODIMENT

Figure 1:
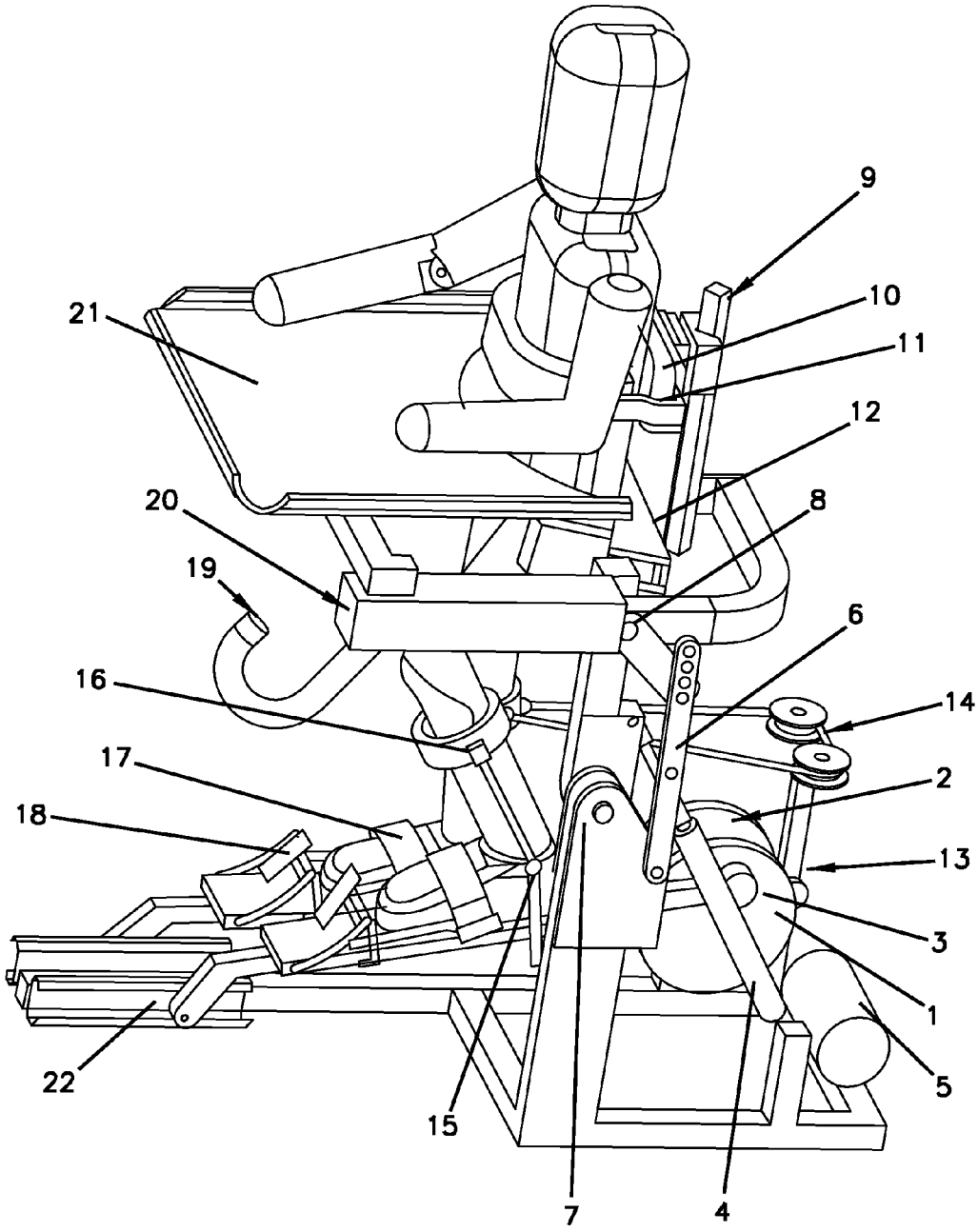
FIG. 1 shows a drawing in perspective of the invention comprising a training apparatus for disabled persons.

With reference to FIG. 1, a detailed description of a motorised training apparatus for disabled persons will be given according to the invention. The whole apparatus is mounted on a skid, with a detailing which follows the reference numerals of FIG. 1. The skid carries at least one pivotable disc, for example two discs 1,2, which are connected to a shaft for rotation around a centre of rotation. To the disc(s) 1,2 are connected two rails in the form of eccentric bars 3. The eccentric bars 3 run from the disc(s) 1,2 to a slip connection at the skid, such that the bars in one embodiment can translatory slide horizontally into the skid, and at the same time can be moved vertically by the eccentric disc(s) 1,2. The bars 3 are running under the seating device (described above) and are equipped with fastening devices for the user's feet. By fastening the feet to the bars 3, the feet will be moved in a controllable manner with the bars 3, in the relevant movement pattern. The disc(s) 1,2 are run by a motor as mentioned above. It will be possible to run the disc(s) 1,2 to rotation around their own axis of rotation, in which case the device functions as a motorised ellipse machine. Alternatively it may be possible to fasten the bars 3, in the skid of the device, at the same time as the disc(s) 1,2 are equipped with grooves in the form of arc segments with the centre in the foremost is fastening point for the bars 3. When operating the disc(s) 1,2, the movement of the bars will, in this embodiment, be more as a stair step movement. An alternative can be to operate the disc(s) 1,2 by a lever movement, which will, when the bars 3 slide into the frame, give a skiing-like movement of the bars 3. It will also be possible to disconnect the discs 1,2 from each other, such that they can be operated individually. This can for example make a skiing movement, where it is suitable that the bars 3 are not being lifted too much in the vertical direction during operation of the device, to be obtained. In such a movement, the discs 1,2 will move alternately back and forth in relation to one another.

To carry out the elliptical movement, two eccentric discs 1,2 are applied, which may be connected to a common shaft. Each of the eccentric discs has an attachment of eccentric bar 3, which can be fastened in different holes with different distances from the centre of the eccentric disc, in order to change the stroke of the walking movement. By fastening the eccentric bars 3 near the axis of rotation for the discs 1,2, a less horizontal, as well as vertical, movement of the bars 3 will be obtained, while fastening into fastening points (for example holes) further away from the axis of rotation for the discs 1,2, will provide a larger stroke of the bars 3, both in a horizontal and vertical direction, and consequently larger "steps" for the patient.

The invention, being the muscular-driven as well as the motorised version, can be applied by a user who utilises all positions from a seated to a standing position. The apparatus can therefore be equipped with a device for serving of the position of the parallelogram, which constitutes the arrangement for seating and erection, in the device according to the invention. Such a device can for example be a pneumatic spring 4, with a lock providing continuous adjustment from the seated to a standing position. The pneumatic spring 4 works on the parallelogram, which the seating device and corrective rail are attached to. Alternatively, or in addition, the up-and-down guiding movement of the parallelogram can be operated manually with a handle. It may also be possible to serve the position of the parallelogram and the seat/support for the lumbar region with other forms of operating devices, such as a gear with a spindle operation (worm gear). It can of course also be possible to operate the piston 4 for serving the seat/support for the lumbar region with the aid of hydraulics as well as pneumatics.

In the motorised version of the device according to the invention, the eccentric discs 1,2 receive power from a motor, which preferably is electrical. In one embodiment, the eccentric disc 2 is operated from a connection to the eccentric disc 1. When the connection is released, the eccentric discs may rotate independently from each other, such that both eccentric bars can be placed in a horizontal position. It would be desirable that the rotational displacement between the eccentric disc 1 and the eccentric disc 2 is 180°, such that this provides a natural walking movement. This is also related to the operation of the stiffening system for the lower leg/knee, explained below (and indicated previously), since the forward movement of one bar 3 will be connected to the backward directed movement of the other bar in the device, via an elastic band/strap/spring which coordinates the user's leg movements.

As a part of the seating/standing arrangement, a bar 6 is used, forming a parallelogram such that the backbone always is vertical. In this connection, the seating height of the seat in the parallelogram can also be adapted for persons of different height, from children to adults. In order to adjust the height according to the user, a "knee joint" 7 is provided which can be adjusted in the height. Similarly, a "hip joint" 8 is provided, in which the distance to the knee joint can be adjusted for adaptation to the user. Thus the relative distance between the hip joint and the knee joint will be larger if the device is adapted to an adult person, compared to if the device is used for a child. It is preferred that such a seating/standing arrangement exists in the form of a parallelogram, but other embodiments can also be possible, such as a sickle form, which ensures that erection by stretching in the hips and support to the knees can be secured in the same way as for a parallelogram.

For adaptation to the back of the user, the apparatus according to the invention includes a back column 9 for the attachment of a back support 10. The back column 9 is, in the shown embodiment of the device, a vertical bar running from the hip joint support to the patient's neck. However, it will be possible to make this column 9 longer, for example in order to stiffen the neck and head of a person who has, for example, been subject to a neck injury, whereby it is important for the person who is injured to keep the head at rest during training. In such cases, the column 9 will also be equipped with fastening devices for neck and head (in addition to fastening means for the user's chest area). The back column 9 is fastened to the support for the back 10 with the aid of transitions, which can be adjusted in the height of the column 9 for adaptation to the user's height. In connection with the support for the back 10, lateral supports 11 are also provided, which can be pivoted out and which constitute a chest support, such that the user's upper part of the body is fastened in use. The chest support corrects the upper part of the body and, with the seating pillow 12 with lateral supports, this constitutes an integral unit which secures the user in all ways and keeps the person in an upright position in use. Since the back/chest support is hinged in the hip joint, the back/chest support will not move considerably (if at all) when the user is moved from a seated to an upright position.

After fastening of an elastic band/spring, strap, bar device 14 (as explained above), to compensate for lack of muscles in the legs, the user can now be raised to a standing position with the aid of a pneumatic spring, a hydraulic spring or a mechanical device, such as by worm operation, manual operation or by electrical operation. In the muscular-operated version of the device it will be relevant to carry out this erectional function manually, even though alternatively in one embodiment it can be driven electrically. When the user is in upright position, he is standing in a corrected and proper standing position provided by the fastening 16 to the lower part of the leg, the hip fastening 8 and the back/chest fastening 10. The elastic band device 14 runs from the hoop 16 for the lower part of the leg, and around for example the roller behind the seat, and has the important function that it shall prevent the user from collapsing in his legs. Further, the elastic band device 14 ensures a natural and necessary stretching of the muscles at the back side of the legs, since the elastic band 14 will stretch the leg backwards with the forward movement of the other leg and vice versa, and ensures that an alternate muscular contraction and muscular stretching will arise when operating the device.

In order to, in the motorised version of the device according to the invention, secure the legs, an adjustable hinge point 15 is provided for the ankle which has a connection with the hoop for the lower part of the leg 16, with the bar in order to keep the leg in the correct position. Additionally, a hoop 17 is provided for fastening of the foot. The hoop is locked with an eccentric locking 18, for hoop to foot.

One embodiment of the invention has also included a releasing unit 19 for brake-on-gas dampening, and a button 20 for the adjustment of the rpm of the motor.

At the same height as the arm there is provided a table top, or other extra equipment 21, which is pivoted to one side when there is no use for it.

The invention also comprises a tightening device 13 for elastic band 14, which rolls against a pinching disk in order to give the correct tightening throughout the whole bar cyclus. The other end of the eccentric bar 3 is arranged with wheels inserted in a rail device for steering the horizontal movement of the eccentric bar. The inserted wheel of the eccentric bar 3 will, in a skiing and walking movement (elliptic movement), be led to horizontally back and forth in its groove in the rail device. If, however, as explained above, it should be desirable with a stair step movement in the device, the wheel on the eccentric bar may be locked to the rail device. If this embodiment of the operation is desirable, the driving wheels 1,2 are equipped with grooves, such that operation of the wheels 1,2 will then force the rails 3 up and down vertically, since the horizontal movement is now locked in that the foremost wheel is now locked in the sliprail. If the driving wheels 1,2 can be pivoted back and forth, a stairstep movement may be provided in that it is not then necessary with grooves for the rail 3, which runs around the whole wheel, but only needs to constitute a part of a circle with the centre in the fastening point for the inserted wheel.

When the user has been raised and is standing in a correct and proper standing position, in the motorised version of the device according to the invention, the motor is started with a speed which can be continuously or gradually adjusted. The user will then be forced to move the legs with the aid of the motor power at the same time as stretching is ensured owing to the elastic band device.

A device as explained above could be made for many different types of disablement, from completely paralysed persons to persons who have mobility, but who need to train coordination and development of correct patterns of movement for walking. It will therefore be possible to construct it with controllers for pneumatic and electrical motor, which can be served by the patient himself, up until embodiments where such attendance is left to the nurse. An advantage with the device according to the present invention is that it saves on space and work. It can be handled either by the patient himself (and thereby liberate workforce so that nursing personnel can do other tasks) or by one nurse only, where previously it was necessary with up to several nurses in order to ensure that the patient moved naturally and correctly.

As mentioned above, the device according to the invention may also work for persons who are "handicapped in movement" (in contrast to persons who are "movement able", see above), that is persons who for one reason or another have unusual motor function in the legs and/or in the body. Examples of such unusual motor functions are also mentioned above, and may comprise persons who are ill (Parkinson's disease, poliomyelitis, spastic diseases, muscular atrophy, etc.) persons who are injured (for example neck/back injuries in traffic injuries, fractural injuries such as femur fractures, hip joint fractures, tibia/fibular fractures, fractures in the foot etc.). For such persons it may be relevant not to carry out the relevant movement completely with a motor, but to the motor can, as the treatment of the disease/injury improves the state of the patient, be successively disconnected in that it, during a time period, can be run as an assisting motor.

In an alternative embodiment, it may also be possible to equip the skid for the device with wheels such that it can move around in its environment. When the device according to the invention is run as a stationary training apparatus, the bars 3 will be moved in a distance from the underlay. By, for example, forming the skid for the device with vertical telescoping parts, it will be possible to lower the bars 3 such that they reach the under layer. By additionally equipping the skid with wheels, it will be possible to move the whole device around in its environment, either by operation of the motor (in which case the wheels may be equipped with a steering arrangement in which the user can steer the position of the device), or by operation with muscular power.

Figure 2:
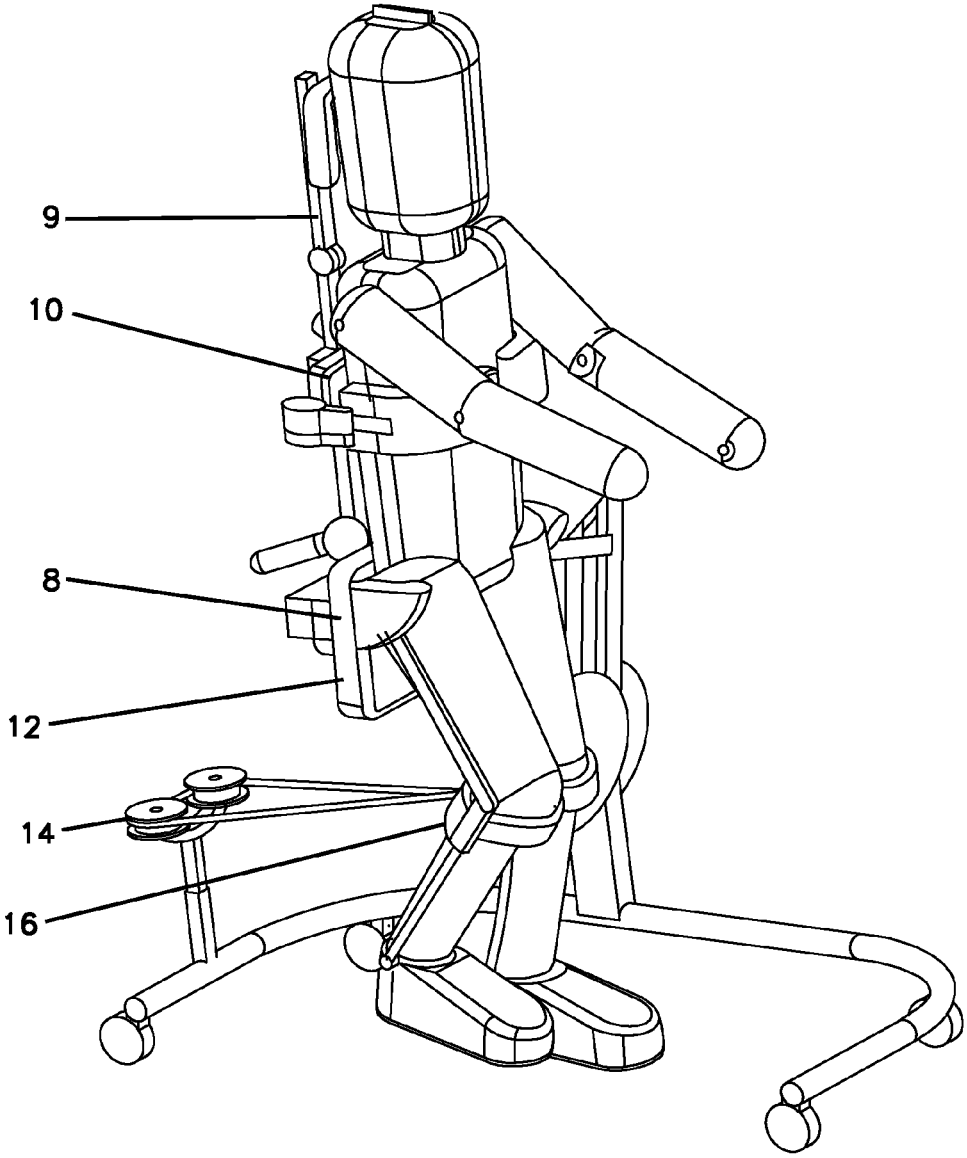
FIG. 2 shows an alternative embodiment of the device according to the invention where the device is not motorised.

In a muscular-operated version of the relevant device, only the leg support, hip support and back support can be present together with the leg support, which will comprise of the withdrawal devices for the knees, as explained above (see FIG. 2).

The material of the device, according to the invention, is not of significance, but it may be desirable that it is of light weight and requires little space. Thus, a suitable material for the device may be aluminium or aluminium alloy, even though another metal may also be used, such as steel or a steel alloy for the wearing parts of the device. Also hard plastics may be used, in particular for the parts which support the body of the patient (chest strap, leg straps, foot straps).

The invention claimed is:

1. An exercise device for a person having a disability, the device comprising:

a frame including a base portion and a vertically extending support portion;

a chest support coupled to the vertically extending support portion to support the upper part of the person's body;

a pivoting seat positioned to support a hip region of the person, the seat having a surface;

a seat adjustment mechanism connecting the seat to the vertically extending support portion, wherein the seat adjustment mechanism includes a parallelogram operable to adjust the position of the seat to a sitting position in which the surface of the seat is substantially perpendicular to the vertical direction of the support portion, and to adjust the position of the seat to a standing position in which the surface of the seat is substantially parallel with to the vertical direction of the support portion;

a motor coupled to the seat adjustment mechanism and configured to provide a force to the seat adjustment mechanism to adjust the seat between the sitting position and the standing position;

a pair of foot supports configured to support the feet of the person;

a motorized elliptical movement device comprising:

at least one disc;

a second motor configured to rotate the at least one disc;

at least two rods, each of the rods including a first end and a second end, wherein the foot supports are each connected to one of the rods between the first end and the second end; and wherein the rods are pivotally connected at the ends to the at least one disc to cause the foot supports to move the feet of the person in an elliptical movement;

a pair of lower leg supports each configured to support a lower leg of the person; and a movement guide mechanism including an elongate force transfer device and a tightening device coupled to the frame, wherein the force transfer device is coupled to the lower leg supports and to the tightening device, and wherein the movement guide mechanism guides alternate movement of the lower leg supports.

2. The exercise device of claim 1, further comprising wheels coupled to the frame.

3. The exercise device of claim 1, further comprising:

at least one disc pivotally coupled to the frame at an axis, wherein the axis is arranged substantially perpendicular to the vertical direction of the support portion;

a motor coupled to the disc and operable to at least pivot the disc about the axis;

at least two rods having a first end and a second end, the first end being pivotally connected to the base, and the second end being coupled to the at least one disc to cause the at least two rods to move upon pivoting of the at least one disc; and fastening devices coupled to the at least two rods and configured to support the person's feet to cause the walking movement of the feet using the at least two rods.

4. A method of exercising a person having a disability, the method comprising:

positioning a hip support device in a sitting position;

raising the hip support device to a standing position in which the weight of the person is supported by legs of the person;

supporting a chest region of the person with a chest support device, wherein when the hip support device is in the standing position, the chest support device supports an upper body of the person in an upright position;

providing two lower leg supports devices to support lower legs of the person;

supporting the feet of the person with foot supports;

providing at least two rods, each of the rods including a first end and a second end, wherein the foot supports each rest on one of the rods between the first end and the second end;

moving the ends of the rods in at least an arcuate path using a motorized device wherein the movement of the ends of the rods cause the feet and legs of the person to move with an elliptical movement; and upon forward movement of one end of one of the rods, applying a rearward force to one end of the other of the rods to guide alternate movement of the lower legs and feet.

* * * * *